US009033177B2

(12) United States Patent
Horne

(10) Patent No.: US 9,033,177 B2
(45) Date of Patent: May 19, 2015

(54) WASTEBASKET

(76) Inventor: Daniel J. Horne, Naples, FL (US)

( * ) Notice: Subject to any disclaimer, the term of this patent is extended or adjusted under 35 U.S.C. 154(b) by 1038 days.

(21) Appl. No.: 13/015,713

(22) Filed: Jan. 28, 2011

(65) Prior Publication Data

US 2012/0024860 A1 Feb. 2, 2012

Related U.S. Application Data

(63) Continuation of application No. 11/893,967, filed on Aug. 17, 2007, now Pat. No. 7,909,200.

(51) Int. Cl.
*B65F 1/06* (2006.01)

(52) U.S. Cl.
CPC . *B65F 1/06* (2013.01); *B65F 1/068* (2013.01); *Y10S 220/9081* (2013.01)

(58) Field of Classification Search
CPC ..... B65F 1/06; B65F 1/065
USPC ..... 220/908.1, 495.11, 495.08, 720, 721, 220/908
See application file for complete search history.

(56) References Cited

U.S. PATENT DOCUMENTS

| | | | | | |
|---|---|---|---|---|---|
| 4,974,746 | A | * | 12/1990 | Dickinson | 220/495.09 |
| 5,058,763 | A | * | 10/1991 | Dickinson | 220/495.09 |
| 5,579,915 | A | * | 12/1996 | Liss | 206/554 |
| 5,709,304 | A | * | 1/1998 | Credle, Jr. | 206/501 |
| 5,836,470 | A | * | 11/1998 | Neelly et al. | 220/4.22 |
| 6,059,138 | A | * | 5/2000 | Labruyere | 220/574 |

* cited by examiner

*Primary Examiner* — Stephen Castellano
(74) *Attorney, Agent, or Firm* — Edward K. Welch, II; IP&L Solutions

(57) ABSTRACT

A wastebasket designed to work in combination with a trash bag insert, the wastebasket having one or more openings or slots on one or more of its sidewalls, the openings extending from the upper rim of the wastebasket to a point near the bottom of the wastebasket, so as to allow for an inward and outward motion of the sidewall sections so as to allow overstuffing of the trash bag while allowing the overstuffed bag to readily be removed from the wastebasket and/or the insertion of a trash bag whose opening circumference is smaller than the upper rim circumference of the wastebasket, whereby the trash bag is secured to the rim of the wastebasket.

13 Claims, 2 Drawing Sheets

Fig 1
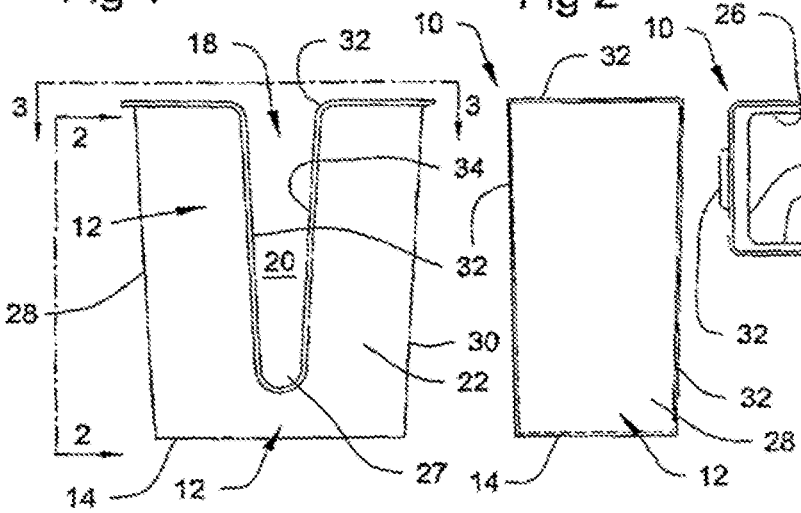
Fig 2
Fig 3
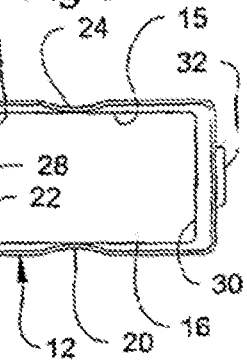
Fig 4
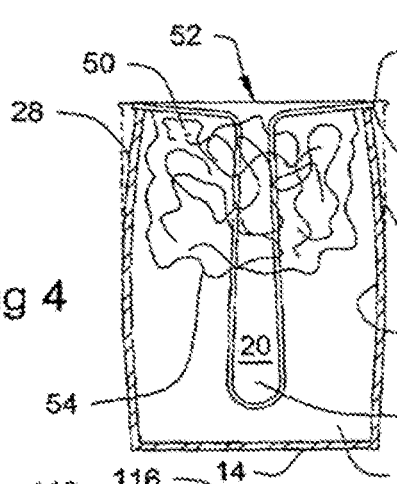
Fig 5
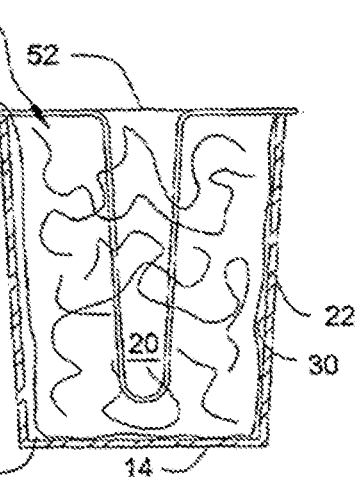
Fig 6
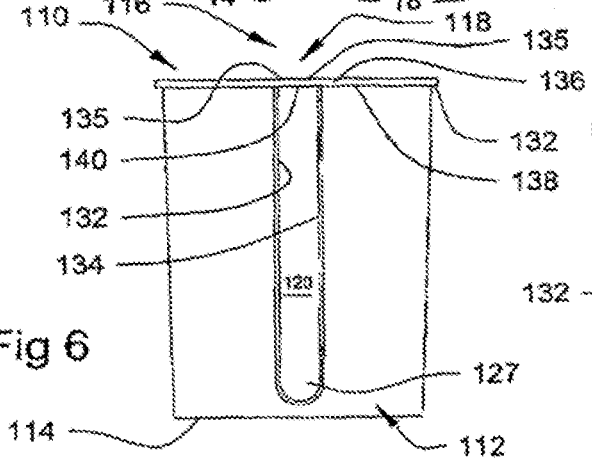
Fig 7
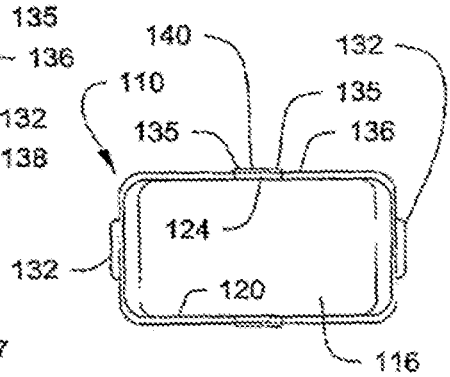

Fig 8
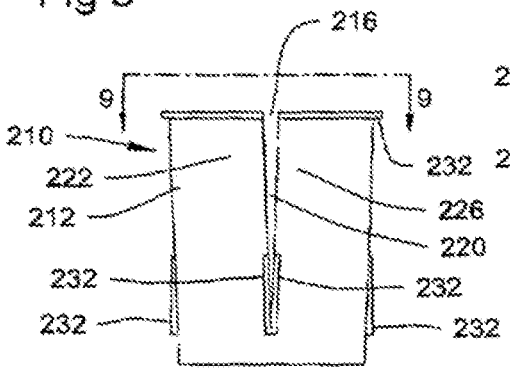
Fig 9
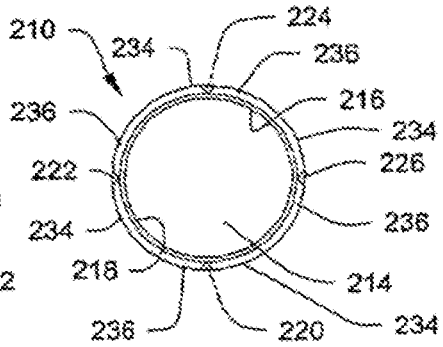
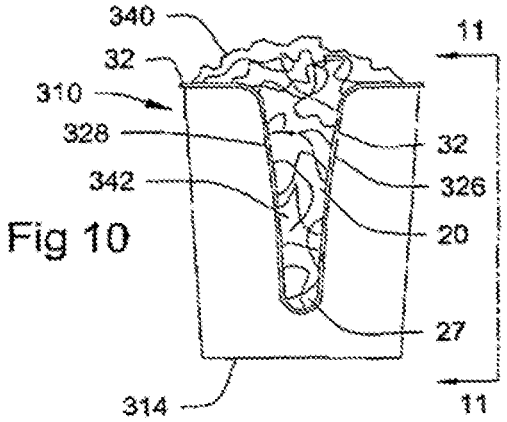
Fig 10
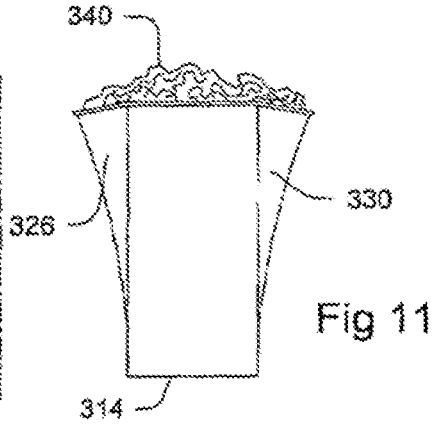
Fig 11
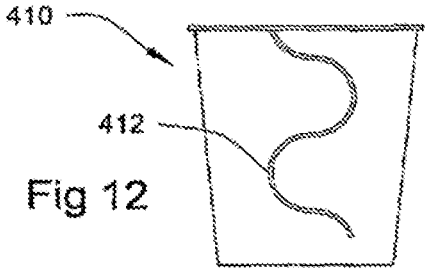
Fig 12
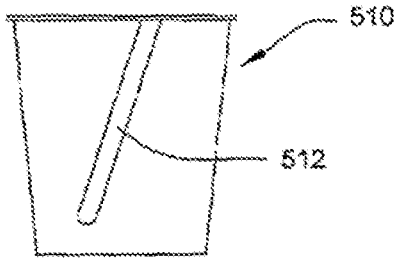
Fig 13

WASTEBASKET

RELATED APPLICATION

The present application is a continuation of U.S. patent application Ser. No. 11/893,967, filed Aug. 17, 2007, now U.S. Pat. No. 7,909,200.

BACKGROUND OF THE INVENTION

Wastebaskets have been used with a plastic bag inserted so that the waste that is put into the wastebasket can be easily removed and properly disposed. Also, most wastebaskets are constructed much like an inverted, truncated cone or pyramid with a non-circular base. That is, theft side, whether round, oval, square, or rectangular in cross-section, has an outward taper, making the bottom of the wastebasket interior smaller than the top of the wastebasket interior. Wastebaskets are now usually made of plastic and, in effect, they are large containers that are waterproof and can receive certain trash bags, also usually of plastic. There are two relatively independent problems with such typical wastebaskets that the present invention addresses. Both problems arise because of the manner of use when using trash bags, particularly plastic trash bags.

The first problem has to do with the use of oversized trash bags. Typically, the plastic trash bag used is somewhat bigger than the wastebasket itself. It is therefore inserted into the wastebasket, and because the plastic bag is larger than the wastebasket, a problem often arises. When putting a plastic trash bag into the typical wastebasket, the open bottom of the bag is inserted through the top of the basket, and the bag's top is still considerably larger than a typical open top of a wastebasket, so it is just wadded up, or is sometimes tied into knot so that it will stay reasonably tight on the rim of a wastebasket. Quite often users will use large rubber bands or bungee cords around the bag top and the wastebasket rim, holding the bag in place. This is cumbersome and time-consuming. The invention herein disclosed and claimed solves this problem.

The second problem is that, while using an overly large trash bag in any wastebasket, including the ones shown herein, often the tendency is to try to get as much trash in the trash bag as possible, at least in part because of the time and effort involved in getting the rubber band or an equivalent off when using the typical wastebasket, then tying the bag so that the contents will not spill, or having no other trash bags readily available at the moment. This often results in overstuffing the bag, pushing the waste down to compact it so that just a little more can be put in it, resulting in the bag acting much like a seal with the inner wall of the wastebasket, making it more difficult to remove the filled bag. This can also occur concurrently with the first problem, trying to put just a little more trash in, even without trying to overstuff the trash bag. Whether or not the wastebasket is tapered, when the engagement of the wastebasket side wall or was by a plastic bag that has been filled fits very tightly, particularly in the lower half of the trash bag, it likely that the lower part of the bag becomes filled with a higher concentration of heavier waste material, whether or not the material has been pushed downwardly until the bag is absolutely full, and then is pushed downwardly some more to be able to put a little more waste in it. This creates pressure in the bag, particularly the lower section of the bag that is still contained by the wastebasket side wall, and that pressure can cause a forced sealing action between the exterior of the trash bag and the interior side wall of typical wastebasket. This seal is in the form of a broad band of perhaps several inches along the outer circumference of the bag and inner circumference of the side wall and effectively seals the bottom section of the wastebasket below the seal. This sealing action leaves little or no opportunity for air to flow past the bag and into the volume of the wastebasket isolated by the seal, i.e., under the bag and around the lower portion of the bag, as the bag is being pulled out of the wastebasket. Consequently, as the bag is being pulled upwardly out of the wastebasket one finds that the resistance of that seal to let the flow of some outside air to enter and fill the increasing space causes a sub-atmospheric pressure to build in the isolated space which sub-atmospheric pressure must be overcome by more strenuously pulling the bag out or by sliding ones hand between the bag and the sidewall to release the seal. Typically, the trash bag has to be pulled as much as half way or more out of the basket before the seal created along a band area of the bag is released as the upward movement of the bag continues.

Many wastebaskets are made of a plastic material that has some give in the sidewalls. When these wastebaskets are overstuffed, this is some bulging in the mid-section of the sidewalls; however, there is no give in the stiff, continuous opening or rim of the wastebasket. Consequently, in those instances where the wastebasket does not have or has a minimal outward taper from its bottom to its rim, removal of the overstuffed bag is further compromised by the interference fit between the bag and the rim. Thus, there are several aspects to be addressed with current wastebaskets. First, currently existing wastebaskets are made or materials that are too stiff to allow for overstuffing without creating significant forces or pressures against the interior side wall and also minimize the degree to which it may be overstuffed. Second, there is difficulty in lifting the filled bag, and even greater difficulty in lifting a heavy and also over-filled bag, out of the wastebasket, due in part to the creation of the seal along the bag/interior sidewall interface which isolates the lower section or volume of the wastebasket and creates a partial vacuum as the bag is being pulled out of the wastebasket.

There have been proposals to put relief openings in the lowest part of the wastebasket or even in its bottom. Other proposals involve making a pipe as a part of the wastebasket that extends upwardly from the wastebasket bottom to its top so that outside air can be taken into the bottom space as the bag is being moved out. The relief openings weaken the bottom and lower part of the basket, and the basket can be standing in just a little water and the bag interior is immediately wetted. Worse, if the bag has liquids that leak from the bag, the liquids will spread out on the floor. The pipes are more costly to make and still must be kept clear of debris, mold, and such that there is always the problem of keeping an open air passage through the pipe.

The potential, and often real, first problem led to the invention, and then it was recognized that the wastebasket construction herein disclosed and claimed also solved the second problem.

FIELD OF THE INVENTION

The invention relates to a wastebasket that makes it extremely easy and very simple to put a plastic bag inside the wastebasket, retain the bag in the wastebasket until the now-filled plastic bag needs to be removed, then remove and dispose the waste materials that have been put into that trash bag, and easily install another trash bag.

The invention also relates to that same wastebasket that will also allow an oversized or expandable trash bag placed in it to expand beyond the normal allowed room for trash bags when packed, and without creating or allowing the formation of a large sealed air space near the bottom of a standard-type wastebasket by the filled trash bag's pressing against an uninterrupted area to form a seal between the trash bag and the wastebasket. That makes it very difficult to pull the filled or overfilled trash bag out of the wastebasket, making it much easier to remove a filled bag, and also making it easier to place an empty bag back in the wastebasket without trapping air within the wastebasket so that it is difficult to fully open the trash bag from top to bottom, and have the installed trash bag to be fully open throughout its depth for the reception of waste.

DESCRIPTION OF THE RELATED ART

There are systems for retaining plastic trash bags in wastebaskets, such as using a rubber band as noted earner, or bungee cords, or providing clasps to grip the trash bag at its open end, and arrangements where the excess part of the trash bag being installed can have some sharp plastic hooks bunt into the wastebasket over which the trash bag excess part at the bag top is hooked, often making a hole in the trash bag material in doing so, as well as sticking the hand of the installer, because such hooks have sharp ends to pierce the trash bag when their top is pushed over them. Such wastebaskets use trash bags that are larger, at least in circumference, relative to the wastebaskets.

BRIEF SUMMARY OF THE INVENTION

The invention includes a wastebasket that has one or more, but often just two, openings in the side wall of the wastebasket. These openings may be relatively narrow slots, or wider ones, that extend from the top of the wastebasket near to but still spaced from the bottom of the wastebasket. The side wall (when the wastebasket is round or made like an inverted truncated cone) or was (when the wastebasket is square or rectangular so that there are several was joined together) still retain their shape but allow for some resilient movement in a cantilever manner. The invention employs their plastic memory trait of always trying to return to their free original position when not prevented from doing so.

There are two types of movement of at least one wastebasket part, and preferably with two or more wastebasket parts, associated with the openings that this construction can accommodate. In the first, the resiliency of the side walls will be used to secure a plastic bag to the top of the wastebasket. Specifically the side wall sections will resiliently resist an inward type of movement, in a cantilever manner, so that the plastic bags whose open end is just slightly smaller in their open circumference than the outside circumference of the wastebasket at the open top of the wastebasket, whether that open top be of a round, partly round or straight-sided, oval, oblong, square, rectangular, or other-shaped multisided wastebasket formed by one or more wastebasket side walls and a bottom connected to the bottom ends of said one or more side walls. The upper ends of the side-wall sections are moved inwardly, toward each other, enough to have the trash bag's open end pulled over them and hold them within that trash bag open end. When the side wall sections are released, they return part way to their normal free positions, and are retained from moving further by the narrower circumference of the trash bag opening; thus, holding the trash bag in place.

The second type of movement relates to the holding capacity of the wastebasket. Here, the side walls have their normally free position so that they have the general appearance of the usual wastebaskets; yet, they will also yield to internal, outwardly directed pressures so as to be bent outwardly to some extent. Specifically, at times, the wastebasket may not be emptied in time, and the extra trash put into the trash bag will be somewhat relieved by some outward lateral movement of those side wall areas that are quite close to the slots or openings.

BRIEF DESCRIPTION OF THE DRAWINGS

FIG. 1 is a side elevation view of one wastebasket embodying the invention.

FIG. 2 is another elevation view of another side of the wastebasket of FIG. 1, taken in the direction of arrows 1-1 of that figure.

FIG. 3 is a view of the top of the wastebasket of FIG. 1, taken in the direction of arrows 3-3 of that figure.

FIG. 4 is a side elevation view of the wastebasket of FIG. 1 showing the flexible skies held inward of their normal position by a trash bag having a slightly smaller circumference than the outside circumference of the wastebasket at the opening of the wastebasket.

FIG. 5 shows the wastebasket of FIG. 4 after the skies have been released, the was returning to the extent permitted by the trash bag: the trash bag still holding the flexible sides slightly bent inward.

FIG. 6 shows a modified wastebasket which has downwardly extending openings in the side sections, the openings having parallel sides that are laterally spaced apart.

FIG. 7 is a top elevation view of the wastebasket of FIG. 6.

FIG. 8 is an elevation view of an alternate embodiment of a wastebasket according to the present invention.

FIG. 9 is a top elevation view of the wastebasket of FIG. 8, taken in the direction of arrows 9-9 of that FIGURE.

FIG. 10 is a side elevation view of the wastebasket shown in FIG. 1 with a trash bag in place, whish trash bag is usually one that has a larger circumference than the wastebasket, having been overstuffed so much with trash that the sidewall at and near the edges of the vertically extending slot or opening edges have been forced slightly outward in a lateral direction by the pressure of the overstuffed trash bag.

FIG. 11 is a side elevation view of the overstuffed trash bag and wastebasket of FIG. 10, taken in the direction of arrows 11-11 of that figure.

FIG. 12 is a side elevation view of still another wastebasket embodying the invention, showing the downwardly extending slot or opening of a more decorative nature, using a serpentine shape.

FIG. 13 is a side elevation view of a wastebasket having a different opening presentation that, while extending downward, extends diagonally rather than vertically.

DETAILED DESCRIPTION OF THE INVENTION

In any configuration of the wastebasket embodying the invention, such as that shown in FIGS. 1-3, there are two or more wastebasket side walls that are separated by the two or more slot-type openings, but more often two, in the side wall, or if more than one in at least one, but more often two, of the side walls. When there is a plurality of openings, they are preferably equally spaced apart along the wastebasket open top, extending downwardly from the wastebasket open top to a low point that is slightly above the wastebasket bottom. If there should be only one such opening, however, the invention can also be practiced, but at times the benefits thereof are not so easily attained. In any event, each such opening will have two generally downward-extending, opposing edges defining the opening so that those edges of each of the openings are parts of two or more side wall sections. There will be one such side wall section for each of the openings, with each of the two or more side wall sections having edges defined by two of the downward openings.

The side wall sections are made of a plastic that has a plastic memory-recovering characteristic that allows each of them to be sufficiently flexible to have their uppermost ends resistively pushed inwardly toward each other; thereby reducing the effective circumference of the top opening of the wastebasket so that a trash bag open end, preferably one whose open end circumference is smaller than the circumference of the wastebasket in its free position, can be folded outwardly and over the wastebaskets rim. The inwardly moved side wall sections are then released, and each of them immediately exerts an outward force on the trash bag open-end area, but does not move back to its free position because the smaller circumference of the open end of the trash bag, engaged by the upper ends of the side wall sections, successfully resists such movement. The plastic memory forces of the side wall sections are therefore unable to return to their free-position location because their upper ends are surrounded by the unyielding plastic bag's circumferential open end, and the trash bag is securely retained on the wastebasket rim.

When the trash bag is to be removed, the two side wall sections are again pressed inwardly until they no longer exert any force on the trash bag open end, and the bag is simply grasped and pulled out of the wastebasket. Because the lower ends of the slots or openings terminate shortly above the trash bottom, preferably at the same position which may be only about two inches above the bottom, air is able to enter below the bag allowing for its ease of removal. That space between the bottom and the lower ends of the openings can be varied considerably, so that any liquid that may have leaked out of the trash bag into the bottom of the wastebasket will still be retained in the bottom of the wastebasket, assuming that it is not in such an unusually large quantity that it would overflow through the openings' lower ends. Such liquids are usually just the remains of the drink in one or more drink containers that have been put into the trash bag. Generally speaking, the point at which the slots or openings terminate above the bottom of the wastebasket is that which is considered sufficient to hold a reasonable volume of such liquids so that it is not spilled out of the wastebasket bottom. If the lower end of one of the openings should be slightly closer to the wastebasket bottom than any other opening end, it will be the one opening end that defines the top of the space that can contain fluid. Additionally, the length of the slots or openings is also important for allowing the desired cantilever action in the sidewalls such that the force or resilience of those side wall sections trying to return to their unfettered positions holds the trash bag in position.

As noted above, the described configuration makes the removal of the trash bags easier because the pressure, particularly from the forcibly expanded trash bag, is easily relieved as the openings or slots allow for an outward lateral movement of the side walls, i.e., a bulging of the sidewalls about the slots or openings, whether due to the overstuffing of the trash bag or manual application of force, which will lessen the grip that the wastebasket has on the side of the trash bag, especially when the trash bag open end is no longer held by the side walls. Additionally, the slots or openings allow air to enter into the space in the lower section of the wastebasket, below the bottom of the trash bag, thereby relieving the momentary sub-atmospheric pressure created in the space between the wastebasket bottom and the bottom of the relatively full trash bag as it is being removed. Here, once the bottom of the trash bag being removed passes the lower end of the slots or openings, if not before, the space that did have some temporary sub-atmospheric air is immediately fully open to the atmosphere and thus no longer has any sub-atmospheric air pressure that resists removal of the trash bag. Furthermore, the slots or openings facilitate the overstuffing of the trash bags as the force of the trash against the sidewalls will allow an expansion of the openings and, hence expansion of the bag in the wastebasket.

The slots or openings may be of several different shapes. For example, they may be shaped with an artistic effect rather than being just straight vertical slots or openings. There may be only one such slot or opening, but it is preferred that there be two or more such slots or openings so that there are two or more side walls acting on the trash bag to hold the trash bag in place as earlier described. Likewise, when the same side walls are being forced further outward from their free position, a bag therein that is being stuffed would not very likely act on just one side of the waste basket, but probably on each side of the slot or opening. This then allows for the wastebasket to bulge a bit about the openings or slots while the others part of the wastebasket do not yield to bulging caused by the pressure when pushing the trash down to make a little more room in the wastebasket. It is also contemplated, as part of the invention, to provide stiffening at or near the edges of the wastebasket formed by the slots or openings so that the strips of wastebasket siding do not move easily outward beyond a reasonable limit. Other means may also be used to resist, or at times even prevent, much outward movements of the wastebasket strips or side walls that are between the slots or openings.

The wastebasket 10 of FIGS. 1, 2 and 3 has a rectangular shape, as seen while looking downwardly at the top of that wastebasket, and is so shown in FIG. 2. Wastebasket 10 has a side wall 12, a bottom 14, and a top opening 16 which is of the same shape as the bottom 14 but is larger so that the interior 18 of the wastebasket tapers inwardly from the top opening 16 to the bottom 14. Wastebasket 10 is shown as having two sots or openings, one opening 20 being in the section 22 of the side wall 12 and the other opening 24 in the section 26 of the side wall 15 which is opposite to the side wall section 22. The other sections 28 and 30 of the side was 12 and 15 have no openings. In this arrangement, the openings 20 and 24 have diverging sides 34, with the bottom 27 of the openings being semi-circular. In the position shown, the side wall sections 28 and 30 are seen here on either side of the opening 20, with the opening 24 being behind the opening 20. These side walls 28 and 30, respectively, are connected with the parts of the section 26 of side wall 12 and other parts of the section 26 of the side wall 15, so that those side walls 28 and 30, and their respective sections of side walls 12 and 15 are integral, and can be flexed to an adequate extent either inwardly or outwardly of their free position shown, i.e., towards or away from each other from the free position as shown in FIG. 1. It is to be understood that the wastebaskets shown herein are all made of a relatively flexible plastic material that has a strong plastic memory to try to return to their free position when they are forced to be resiliently moved inwardly or outwardly against sufficient force urging them inwardly or outwardly.

The top opening 16 and the two openings 20 and 24 have an outwardly extending structure or rim 32, made as a bead or a planar part, outlining them and extending outwardly from the side wall sections 22, 26, 28, and 30, and the openings 20 and 24. The portions of structure 32 that are at the top of the side sections 28 and 30 may be extended outwardly to provide handles for lifting the wastebasket, as needed, as shown in FIG. 3. The structure also acts as a stiffening member that resists bending and movements of the parts that would be more likely to bend and move when the wastebasket is substantially full of trash. Depending upon the flexibility of the material of which the wastebasket is made, some excess flexibility usually will require stiffening by the beaded edging all along the openings 20, as shown. Other less flexible materials of which the wastebasket is made may dispense with some or even all of the beaded edging along the openings 20.

FIG. 4 shows the use of the invention in making it very easy to install and remove trash bags into and out of wastebaskets. As earlier noted, the wastebasket shown is the wastebasket 10 of FIG. 1, but the arrangement also applies to other wastebasket arrangements, including those of FIGS. 2 through 8. The only requirement for this use is the provision of trash bags 50 that are slightly smaller in circumference, particularly at the area of their open ends 52, than the inner circumference of the rim 32 that is located at the top opening 16 of the wastebasket 10. Each trash bag 50 should also be somewhat longer than the depth of the wastebasket, so that its bottom 54 can engage, or be quite near to, the bottom of the wastebasket while a part of its open end area can be placed over the wastebasket rim and down its outer side, or may extend longer down the outside of the wastebasket. FIG. 5 shows the wastebasket 10 and the plastic bag 50 in position, ready to receive trash, with the bag's being secured at its top and the main part of the bag well inside the wastebasket 10.

The wastebasket 110 of FIG. 6 also has a rectangular shape as seen while looking downwardly at the top of that wastebasket, as shown in FIG. 7. Wastebasket 110 has a side wall 112, a bottom 114 and a top opening 116 which is of the same shape as the bottom 114 but is larger so that the interior 118 of the wastebasket tapers downwardly and inwardly from the top opening 116. Wastebasket 110 is shown as having two slots or openings, one opening 120 being in the section 122 of the side wall 112 and the other opening 124 in the section 129 of the side wall 112 which is opposite to the section 122. The other sections 128 and 130 of the side wall 112 have no openings like the openings 120 and 124. In this arrangement, the openings 120 and 124 have parallel sides 134, with the bottom 126 of the openings being semi-circular.

The top opening 116 and the two openings 120 and 124 have an outwardly extending structure or rim 132 made as a bead or a planar part outlining them and extending outwardly from the side wall sections 122, 128, 129 and 130, and the openings 120 and 124. Portions of structure 132 that are at the top of the side sections 129 and 130 are extended outwardly and may provide handles for lifting the wastebasket, as needed. The structure also acts as a stiffening member that resists bending and movements of the parts that would be more likely to bend and move when the wastebasket is substantially full of trash.

The structure or rim 132 is somewhat eider than the structure of rim 32 of FIGS. 1, 2 and 3 and is rolled so as to form a tubular opening 135. Opposite ends 136 and 138 of a sliding rod 140 extend into those tubular openings across the top of the openings 120 and 124. The rod is spring-loaded to normally have the position shown in FIGS. 6 and 7, and may be moved sufficiently to latch it in place so that the openings 120 and 124 are not blocked, and can allow somewhat freer movements of the sections 122 and 128 than is avowed when the rod 140 is in its latched position, as shown in FIGS. 6 and 7.

The wastebasket 210 of FIGS. 8 and 9 is round in shape as seen while looking downwardly at the top of that wastebasket, as shown in FIG. 9. Wastebasket 210 has a circular side wall 212, a round bottom 214 and a round top opening 216 which is of the same shape as the bottom 214 but is larger so that the interior 218 of the wastebasket conically tapers downwardly from the top opening 216. Wastebasket 210 is shown as having four slots or openings 220, 222, 224 and 226. These openings are positioned in the side wall 212 at 90° intervals, as is best seen in FIG. 9.

The top opening 216 and the four openings 220, 222, 224, and 226 have an outwardly extending structure or rim 232, made as a bead or a planar part, outlining the openings and extending outwardly from the side walls at the lower parts of the openings 220, 222, 224 and 226. These structures also act as a stiffening member that resists bending and movements of the parts that would be more likely to bend and move when the wastebasket is substantially full of trash.

In one general configuration, as shown in FIGS. 1-3, 6, 7, and 10-13, there are two or more wastebasket side walls that are separated by the two or more slot-type openings in at least one of the side wall or walls, and when being a plurality of openings being preferably equally spaced apart at the wastebasket open top, extending downwardly from the wastebasket open top to a low point that is slightly above the wastebasket bottom. If there should be only one such opening, however, the invention can also be practiced, but not as easily. In any event, each such opening will have two generally downward-extending edges defining the opening so that those edges of each of the openings are parts of two or more side wall sections. There will be one such side wall section for each of the openings, with each of the two or more side wall sections 28 and 30 having edges defined by two of the generally downwardly extending openings. The side wall sections are made of a plastic material that has a plastic memory-recovering characteristic that allows each of them to be sufficiently flexible to have their uppermost ends resistively pushed inwardly toward each other, reducing the effective circumference of the top opening 16, 116, etc., of the wastebasket and the trash bag open end 52 is just folded outwardly and over the wastebasket's rim 32, 132, etc. The inwardly moved side wall sections are then released and each of them immediately exerts an outward force on the trash bag open end area 52, but do not move back to their free position because of the smaller circumference of the open end 52 of the trash bag 50. Their plastic memory forces are therefore unable to be allowed to return to their free-position location because their upper ends are surrounded by the unyielding plastic bag's circumferential open end 52, and the trash bag 50 is securely retained on the rim of the wastebasket. When the trash bag 50 is to be removed, the two side wall sections 28 and 30 are again pressed inwardly unto they no longer exert any force on the trash bag open end, and the bag is simply grasped and pulled out of the wastebasket.

Because the lower ends 26,126, etc., of the slots or openings terminate shortly above the bottom 14, 114, etc. of the wastebasket, preferably only about two inches, although that can be varied considerably, any liquid that may have leaked out of the trash bag 50 into the bottom of the wastebasket will still be retained in the bottom of the wastebasket. This assumes, of course, that the quantity of liquid is not such an unusually large quantity that would overflow through the openings' lower ends and that the bottom of the trash bag has leaked. Typically, this liquid is just the remains of the drink in one or a few drink containers that have been put into the trash bag. Generally speaking, the height of the terminal ends 26, 126, etc., of the slots or openings is that which is considered sufficient to hold a reasonable volume of liquids so that it does not spill out of the wastebasket bottom.

FIGS. 10 and 11 show the wastebasket 310, which is the same as the wastebasket 10 of FIG. 1, with some trash 340 having been stuffed downwardly into a plastic bag 342 that had been earlier inserted into the wastebasket 310. Usually, the trash bag 342 is larger that the wastebasket 310 when persons tend to try to stuff more waste material into the bag. The relatively larger bag 342 also has an excess of material defining its opening, and this excess material is just gathered up or is tied with a knot to make it fit the top opening of the wastebasket 310. These figures show a wastebasket in which the trash had been pushed and stuffed into the plastic trash bag 342, with the lower part of the trash bag being filled even more densely near the wastebasket bottom 314, and still some trash 340 sticking up over the top of the wastebasket 310.

Although the description the wastebasket 10 of FIGS. 1, 2, and 3 is most frequently referred to, it is to be understood that this description of FIGS. 10 and 11 generally relates to all of the wastebaskets shown in the drawings. When the plastic trash bag 342 was inserted into the top opening of wastebasket 310, or in any of the disclosed wastebaskets 10, 110, or 210, it can be moved downwardly more easily without any trapped air being under it because of the openings 20 and 24, 120 and 124, 220 and 224, and 320, 322, 324, and 326. If necessary, the person putting it in can reach into at least the upper part of one of those openings and guide or pull the bottom of the trash bag 342 to be sure that it is down sufficiently and fitted at least close to the interior wall of the sections of the basket side wall. It is also a usual practice to place both hands into an opened plastic trash hag 342 and keep them there, spread apart to keep the trash bag reasonably open. After the bag has been inserted into the wastebasket, hands spread the trash bag out so that little air is trapped under it, within the wastebasket 310. Even then, there is still some air trapped under the trash bag. As the trash is put into the trash bag, the bag fills up, and it will begin to engage the interior surfaces of the side sections 322, 326, 328, and 330 or the equivalent side sections of any of the other disclosed wastebaskets, or a standard type of wastebasket having no means provided particularly for this purpose. When the trash 340 is pushed further into the trash bag 342, it will cause there to be some pressure on the wastebasket inner was 318. When that pressure builds up throughout the trash bag, the portions of the sides 322, 326, 328 and 330 will fed the pressure.

In contrast, a wastebasket having a solid bottom and side wads has no ability to compensate for the pressure build up which only increases as more and more trash is added: here the only things that try to yield to the pressure are the trash and the trash bag that is inside the wastebasket. In that situation, the trash bag, particularly the lower part of the trash bag, becomes pressed against the wastebasket inner wall making it difficult to extract the bag from the wastebasket. In particular, lower portion of the trash bag forms and air tight band with the inner wall of the wastebasket with a high pressure or force against the inner wall of the wastebasket that strongly resists any removal of the full trash bag. Additionally, as one tries to remove the overstuffed trash hag, no air is able to bypass the trash bag such that a sub-atmospheric condition is created in the lower portion of the wastebasket beneath the trash bag, making it further difficult to extract the trash bag.

When using a wastebasket in accordance with the invention herein disclosed and claimed, that pressure can become sufficient to cause the wall sections 22 and 26, 122 and 126, 222 and 226, or 322 and 326, to move outwardly, yielding to that inside force caused by tightly stuffing trash into the trash bag and the wastebasket itself. This is shown in FIGS. 8 and 9. This yielding action lessens the pressure of the filled trash bag against the inner wall of the wastebasket, making its removal easier. Also, because the slot allows for the inflow of air, the sub-atmospheric pressure that was in the bottom of the wastebasket is likewise release, if it forms at all. Thus, when an overstuffed trash bag is being lifted out of the wastebasket, it will have less resistance to such movement at the beginning, and as soon as even a part of the trash bag clears the lowest part of the openings and can be lifted out much more easily. This advantage can even be felt when the trash bag is fairly full but has not been overstuffed.

While the disclosures in FIGS. 1 through 11 only show openings or slots having straight sides, either diverging or parallel, it is within the purview of the invention to provide one or more openings similar to those openings at a diagonal angle to the vertical, curved, serpentine or sinuous, or even straight but zigzagged. Alternatively, they may employ a combination of any two or more of these shapes. The shapes of such openings may include artistic effects. Some of such openings may be in combination with a scene so that it appears that a part of the scene has moved when the part of the wastebasket defining the openings moves in response to being stuffed or overstuffed with trash, as shown in FIGS. 8 and 9. Even so, any such openings are considered to be equivalent to those shown when they function in the same manner when the wastebaskets are filled, and even more so when they function in the manner set forth when the wastebaskets are overstuffed. FIGS. 12 and 13 show two of such samples. The wastebasket 410, shown in FIG. 12, has an opening 412 that extends downwardly, but is sinuous or serpentine in shape. The wastebasket 510 in FIG. 13 shows an opening 512 that extends downwardly, but is diagonally positioned relative to the upper edge of the sidewall.

I claim:

1. A wastebasket comprising a bottom and a side wall whose bottom end is contiguous with the circumference of the bottom and whose upper edge serves as a discontinuous rim defining an open top to the wastebasket, the side wall and the bottom defining the volume of the wastebasket, the volume and size of the wastebasket being typical of a conventional wastebasket in which a trash bag removable by an individual is placed for holding the trash, the side wall having one or more wall sections, each having an exterior surface and an interior surface, wherein the side wall a) is made of a flexible and resilient material capable of flexing under manual force and reverting to its original shape upon removal of the manual force and b) has at least two openings extending from and including the side wall's upper edge towards the bottom of the wastebasket, said openings i) being defined by opposing edges in said side wall and an opening bottom and ii) having a width and length such that the exertion of manual force on the upper, exterior surface of the side wall in the direction of the openings causes the upper portions of the opposing edges of the openings to approach one another and, upon removal of the manual force, to retract from one another in an effort to return to their natural position, said wastebasket being adapted, as a result of the aforementioned configuration, to accept a trash bag or liner whose upper open end has a circumference that is smaller than the circumference of the rim of the wastebasket: acceptance being achieved by applying manual force to effect the aforementioned movement in the side walls, draping the opening of the bag about the rim of the waste basket in a conventional manner, and releasing the manual force to allow the rim of the wastebasket to securely hold the trash bag or liner in place wherein the side wall of the wastebasket has at least two sections each having an opening extending from and including its upper edge to a point slightly above the bottom of the wastebasket, wherein the at least two wall sections having openings opposed one another.

2. The wastebasket of claim 1 wherein the openings are equally spaced from one another about the rim of the wastebasket.

3. The wastebasket of claim 1 wherein the openings extend to a point that is no more than about two inches above the bottom of the wastebasket.

4. The wastebasket of claim 1 wherein the openings oppose one another.

5. The wastebasket of claim 1 wherein the edges of the openings diverge such that the distance between the opposing edges of the openings is greater at one end of the opening than at the other end.

6. The wastebasket of claim 1 wherein the edges of the openings are parallel to one another.

7. The wastebasket of claim 1 wherein the openings have a serpentine design.

8. The wastebasket of claim 1 wherein the openings are at a diagonal to the upper edge of the side wall.

9. The wastebasket of claim 1 wherein the length of the openings is sufficiently long to allow the wall sections about the openings to move outwardly in a lateral motion upon outward force against the inner surface of the side walls.

10. The wastebasket of claim 1 wherein the length of the openings is such that they extend to a point that is about two inches or less from the bottom of the wastebasket.

11. The wastebasket of claim 1 wherein the bottom shape, and hence the general cross-sectional shape, of the wastebasket is round, oval, square or rectangular.

12. The wastebasket of claim 1 wherein the cross-sectional shape of the wastebasket is square or rectangular having four wall sections with an opening on one opposing pair of wall sections and no openings in the other opposing pair of wall sections.

13. The wastebasket of claim 1 wherein the portion of the sidewall between the bottom of the wastebasket and the openings defines a reservoir to hold liquids.

* * * * *